US005810258A

United States Patent [19]

Wu

[11] Patent Number: 5,810,258

[45] Date of Patent: Sep. 22, 1998

[54] PAINT CUP MOUNTING ARRANGEMENTS OF A PAINT SPRAY GUN

[76] Inventor: Yu-Chin Wu, No. 418-5, Min-Chu Rd., Sec. 1, Tan-Tzu Hsiang, Taichung County, Taiwan

[21] Appl. No.: 944,099

[22] Filed: Sep. 30, 1997

[51] Int. Cl.[6] ..... B05B 7/30

[52] U.S. Cl. ..... 239/346; 239/349; 239/DIG. 14

[58] Field of Search ..... 239/345, 346, 239/377, 302, DIG. 14

[56] References Cited

U.S. PATENT DOCUMENTS

| | | | |
|---|---|---|---|
| 930,087 | 8/1909 | Reich | 239/345 |
| 4,978,072 | 12/1990 | Kurowski | 239/346 |

FOREIGN PATENT DOCUMENTS

| | | | |
|---|---|---|---|
| 1512675 | 10/1989 | Russian Federation | 238/345 |
| 139833 | 3/1920 | United Kingdom | 299/88 |

*Primary Examiner*—Andres Kashnikow
*Assistant Examiner*—David Deal
*Attorney, Agent, or Firm*—Rosenberg, Klein & Bilker

[57] ABSTRACT

A paint cup mounting arrangement including a mounting cylinder fastened to a paint spray gun by a screw joint, a socket sleeved onto the mounting cylinder and turned thereabout, a paint cup fastened to the socket by a screw joint, and a paint guide tube mounted within the mounting cylinder and the socket and sealed by rubber seal rings and adapted to guide paint from the paint cup to the paint spray gun, the paint cup being adjusted to a vertical position by turning the socket about the mounting cylinder.

3 Claims, 4 Drawing Sheets

A – A

PAINT CUP MOUNTING ARRANGEMENTS OF A PAINT SPRAY GUN

BACKGROUND OF THE INVENTION

The present invention relates to paint spray guns, and more specifically to a paint cup mounting arrangement for a paint spray gun which permits the paint cup to be conveniently adjusted to a vertical position during a paint-spraying operation.

FIG. 1 shows a regular paint spray gun in which the paint cup 11 is fixedly fastened to the casing 100 of the paint spray gun. Because the paint cup 11 is fixedly secured to the casing 100 of the paint spray gun, its angular position is not adjustable. If the paint spray gun is held in a tilted position, paint may flow out of the paint cup. Further, because the paint cup 11 is not detachable, the user cannot replace the paint cup 11 subject to the desired volume.

SUMMARY OF THE INVENTION

The present invention has been accomplished to provide a paint cup mounting arrangement which eliminate the aforesaid problems. According to one aspect of the present invention, the paint cup mounting arrangement comprises a mounting cylinder fastened to a paint spray gun by a screw joint, a socket sleeved onto the mounting cylinder and turned thereabout, a paint cup fastened to the socket, and a paint guide tube mounted within the mounting cylinder and the socket and sealed by rubber seal rings and adapted to guide paint from the paint cup to the paint spray gun, the paint cup being adjusted to a vertical position by turning the socket about the mounting cylinder. According to another aspect of the present invention, the paint cup is detachably fastened to the socket by threading a threaded bottom neck thereof into a radial screw hole of the socket. According to still another aspect of the present invention, a T-groove is made on the periphery of the mounting cylinder in a longitudinal direction so that the mounting cylinder can be compressed inwards for permitting the socket to be smoothly turned about the mounting cylinder to adjust the angular position of the paint cup.

DETAILED DESCRIPTION OF THE PREFERRED EMBODIMENT

Figure 1:
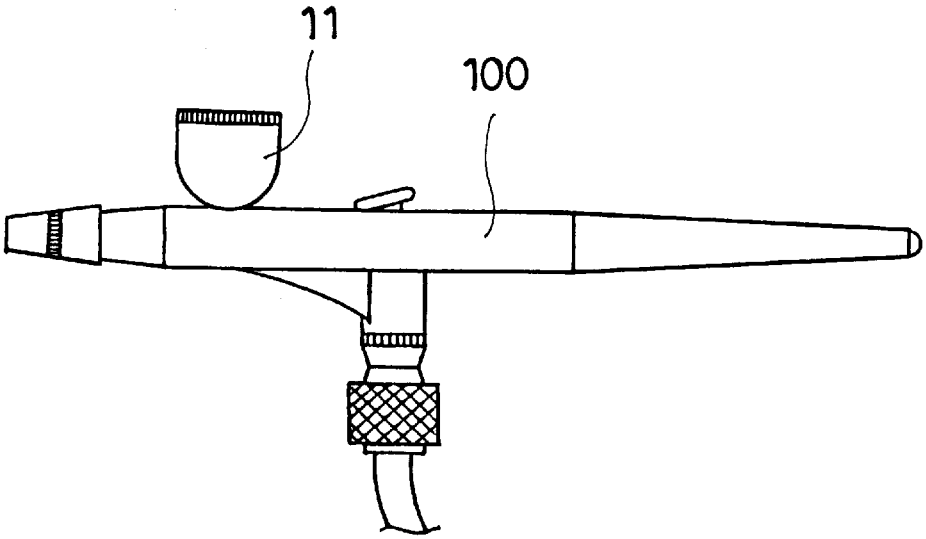
FIG.1 PRIOR ART
FIG. 1 is a plain view of a paint spray gun according to the prior art.
Figure 2:
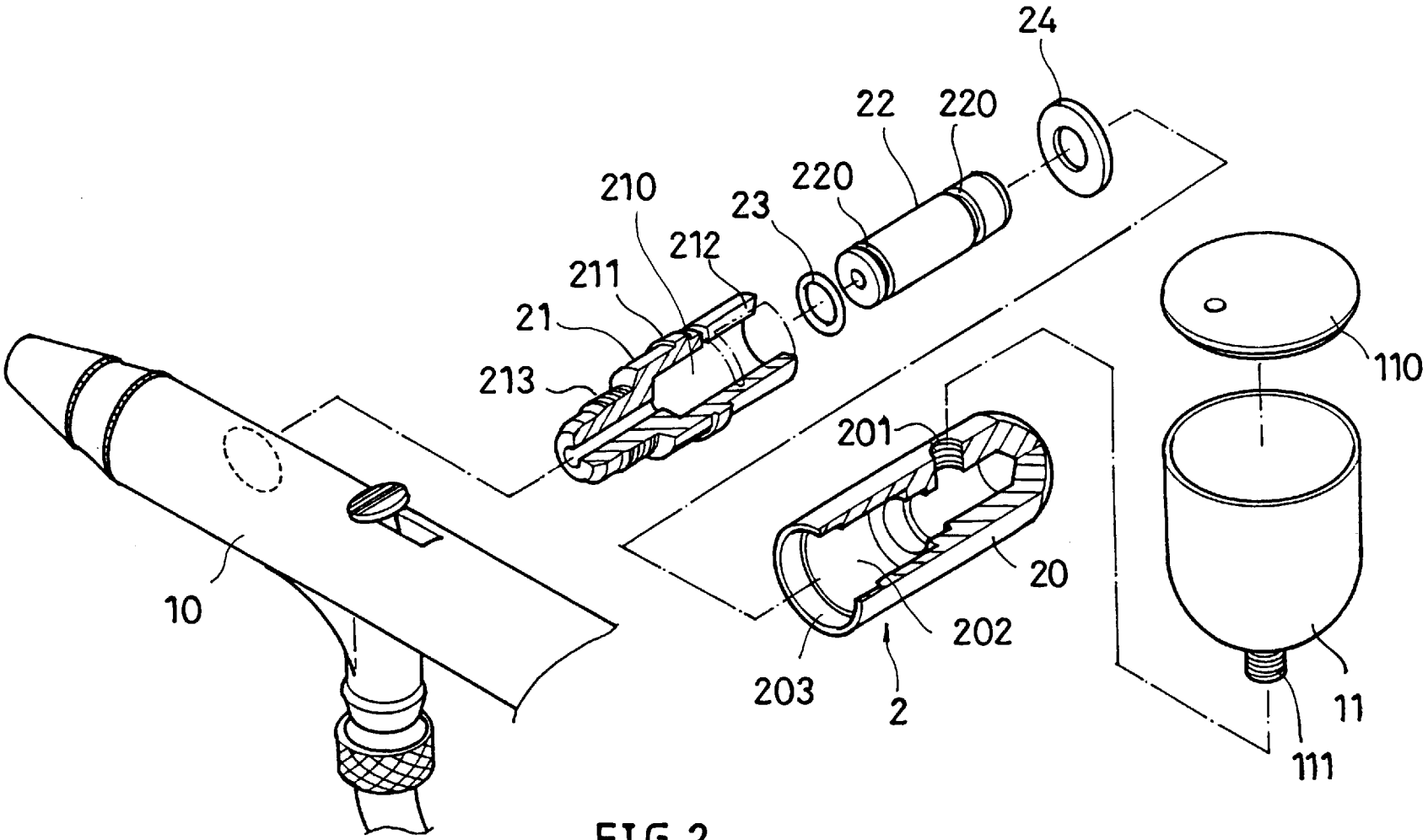
FIG. 2 is an exploded view of the present invention.
Figure 3:
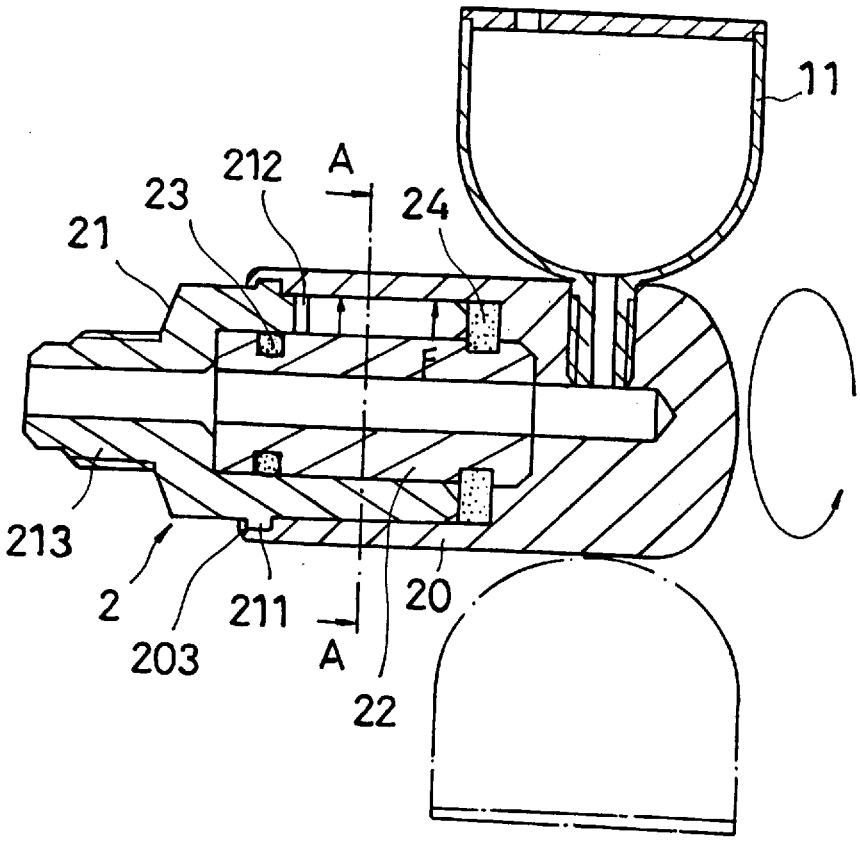
FIG. 3 is a sectional view showing the adjustment of the angular position of the paint cup according to the present invention.
Figure 3A:
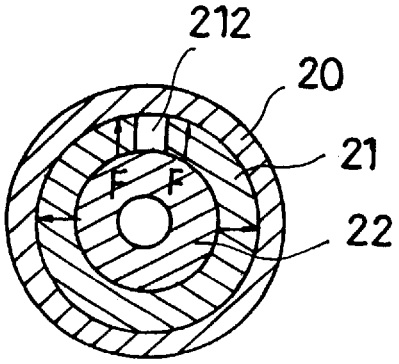
FIG. 3A is a sectional view taken along line A—A of FIG. 3.

Referring to FIGS. 2 and 3, a rotary mounting device 2 is installed in a paint spray gun 10 to hold a paint cup 11, for permitting paint to be guided out of the paint cup 11 into the paint spray gun 10 for spraying over the object to be painted.

The rotary mounting device 2 comprises a socket 20, a mounting cylinder 21, and a paint guide tube 22. The socket

20 comprises a stepped receiving chamber 202 longitudinally extended to its front open side, a screw hole 201 through the periphery in communication with the stepped receiving chamber 202, and an inward coupling flange 203 raised from its inside wall around its front open side. The mounting cylinder 21 is mounted in the stepped receiving chamber 202 of the socket 20, comprising a longitudinally extended cylindrical receiving chamber 210, a coupling flange 211 raised around the periphery in the middle and forced into engagement with the coupling flange 203 of the socket 2, a T-groove 212 longitudinally disposed adjacent the coupling flange 203, and a threaded front neck 213 fastened to the paint spray gun 10. The paint guide tube 22 is mounted in the receiving chamber 210 of the mounting cylinder 21 and the receiving chamber 202 of the socket 2, having two annular grooves 220 spaced around the periphery. Two rubber seal rings 23;24 are respectively mounted on the annular grooves 220, and forced into close contact with the periphery of the receiving chamber 210 of the mounting cylinder 21 and the periphery of the receiving chamber 202 of the socket 20 respectively. The paint cup 11 is covered with a cap 110, having a threaded hollow neck 111 at its bottom side threaded into the screw hole 201 of the socket 2. When assembled, the socket 2 can be turned about the mounting cylinder 21 to adjust the angular position of the paint cup 11, and paint is allowed to be guided out of the threaded hollow neck 111 of the paint cup 11 through the rear end of the receiving chamber 202 of the socket 2, the paint guide tube 22, the threaded neck 213 of the mounting cylinder 21 into the paint spray gun 10.

Figure 4A:
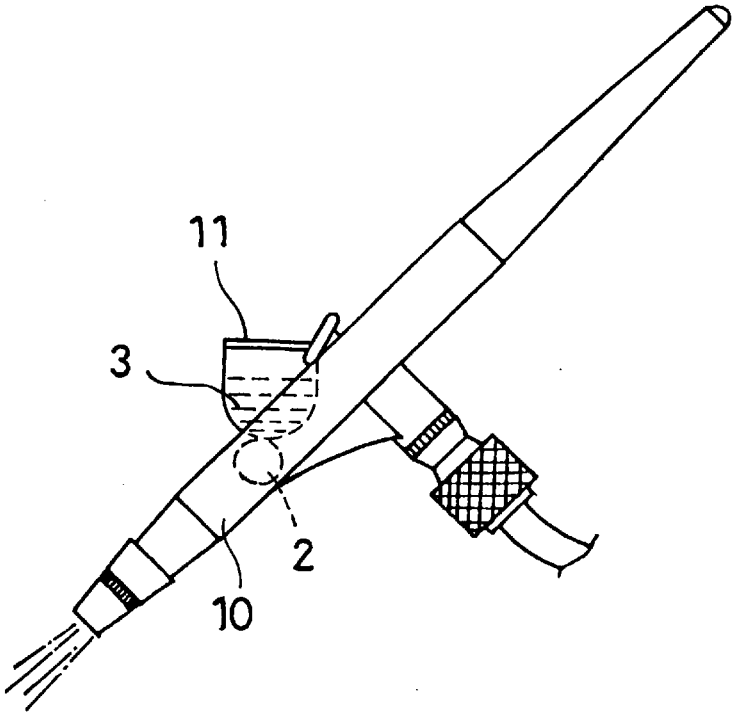
FIG. 4A is an applied view of the present invention, showing the paint spray gun held in a downward spraying position, the paint cup retained in a vertical position.
Figure 4B:
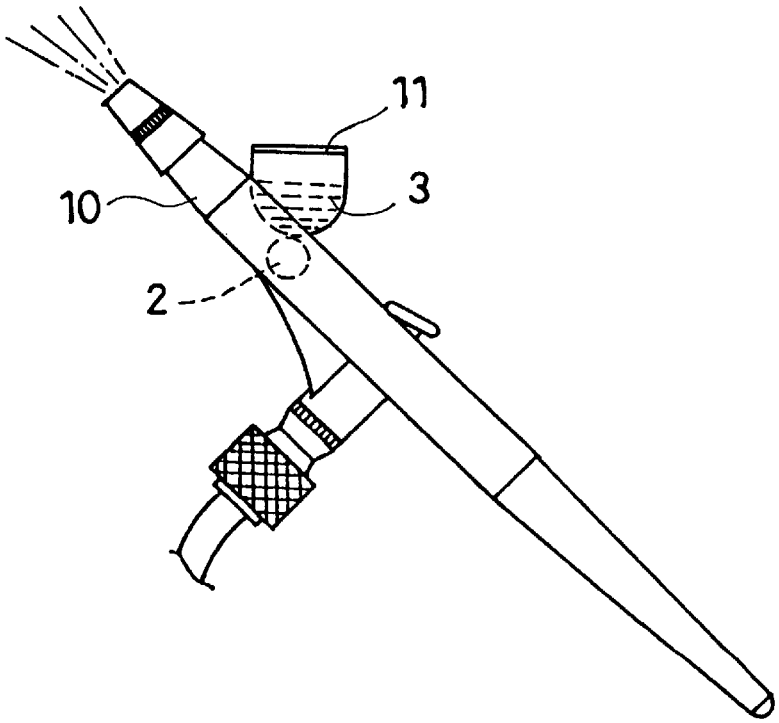
FIG. 4B is another applied view of the present invention, showing the paint spray gun held in an upward spraying position, the paint cup retained in a vertical position.

Referring to FIGS. 3, 4A and 4B, when in use, the paint cup 11 is filled up with paint 3. When the paint spray gun 10 is turned downwards for painting a lower area of the workpiece, the socket 2 is turned about the mounting cylinder 21 to keep the paint cup in a vertical position (see FIG. 4A). Because the outer diameter of the mounting cylinder 21 around the T-groove 212 is approximately equal to the inner diameter of the corresponding area of the socket 2, when the socket 2 is turned about the mounting cylinder 21, the T-groove 212 is compressed for permitting the socket 2 to be smoothly turned about the mounting cylinder 21. After adjustment, the T-groove 212 returns to its former shape, and the outside wall of the mounting cylinder 21 is closely stopped against the inside wall of the socket 20, and therefore the socket 20 is retained to the mounting cylinder 21 at the adjusted position. On the contrary, when the paint spray gun 10 is turned upwards for painting an upper area of the workpiece, the socket 2 is turned about the mounting cylinder 21 in the reversed direction to keep the paint cup 11 in a vertical position (see FIG. 4B). Therefore, the pain cup 11 can be conveniently adjusted to a vertical position when the paint spray gun 10 is held in any of a variety of spraying angles.

While only one embodiment of the present invention has been shown and described, it will be understood that various modifications and changes could be made thereunto without departing from the spirit and scope of the invention disclosed.

What the invention claimed is:

1. A paint cup mounting arrangement comprising:

a mounting cylinder fastened to a paint spray gun by a screw joint and adapted for guiding paint from a paint cup to said paint spray gun for spray-painting, said mounting cylinder comprising a threaded front neck fastened to said paint spray gun, a coupling flange raised around the periphery in the middle, a longitudinally extended receiving chamber, and a longitudinal groove longitudinally extended to a rear end thereof remote from said threaded front neck;

a socket sleeved onto said mounting cylinder and turned thereabout, said socket comprising a stepped receiving chamber having a broad front half fitting over the periphery of said mounting cylinder and a narrow rear half disposed outside said mounting cylinder, a screw hole through the periphery in communication with the narrow rear half of said stepped receiving chamber, and an inward coupling flange raised from an inside wall of a front open side thereof and forced into engagement with the coupling flange of said mounting cylinder;

a paint guide tube mounted in the longitudinally extended receiving chamber of said of said mounting cylinder and the narrow rear half of the stepped receiving chamber of said socket and adapted for guiding paint from a paint cup to said paint spray gun; and a paint cup covered with a cap and mounted on said socket for holding paint for permitting paint to flow to said paint spray gun through the narrow rear half of the stepped receiving chamber of said socket, said paint guide tube and the threaded neck of said mounting cylinder, said paint cup having a threaded hollow neck extended from a bottom side thereof and threaded into the screw hole of said socket through which paint flows to said paint spray gun.

2. The paint cup mounting arrangement of claim 1, wherein said paint guide tube has two annular grooves spaced around the periphery, and two rubber seal rings are respectively mounted on the annular grooves of said paint guide tube to seal the gap between the periphery of said socket and the periphery of said mounting cylinder and the gap between the periphery of said socket and the periphery of said paint guide tube.

3. The paint cup mounting arrangement of claim 1, wherein the longitudinal groove of said mounting cylinder has a T-shaped cross section.

* * * * *